US007785134B2

(12) United States Patent
Dhandapani et al.

(10) Patent No.: US 7,785,134 B2
(45) Date of Patent: Aug. 31, 2010

(54) CONTACT TERMINAL FOR CONDUCTORS

(75) Inventors: Kathiravan Dhandapani, Karnataka (IN); G. Kalyana Sundaram, Karnataka (IN); Subramanian Nagarajan, Nagercoil (IN)

(73) Assignee: General Electric Company, Schenectady, NY (US)

( * ) Notice: Subject to any disclaimer, the term of this patent is extended or adjusted under 35 U.S.C. 154(b) by 26 days.

(21) Appl. No.: 12/345,929

(22) Filed: Dec. 30, 2008

(65) Prior Publication Data

US 2010/0167573 A1 Jul. 1, 2010

(51) Int. Cl.
*H01R 11/20* (2006.01)

(52) U.S. Cl. ..... 439/441; 439/835

(58) Field of Classification Search ..... 439/436–441, 439/835–838

See application file for complete search history.

(56) References Cited

U.S. PATENT DOCUMENTS 3,138,421 A * 6/1964 Locher et al. ..... 439/440
5,860,837 A * 1/1999 Bock et al. ..... 439/828
6,146,187 A * 11/2000 Pallai ..... 439/441
6,350,162 B1 2/2002 Despang
6,682,364 B2 * 1/2004 Cisey ..... 439/441
6,689,955 B2 * 2/2004 Doutaz ..... 174/652
6,712,641 B2 3/2004 Beege et al.
6,796,855 B2 * 9/2004 Fricke et al. ..... 439/835
6,851,967 B2 2/2005 Miyoshi et al.
6,893,286 B2 5/2005 Drewes et al.
6,911,602 B2 6/2005 Conrad
7,083,463 B2 8/2006 Steinkemper et al.
7,244,140 B2 7/2007 Edenharter
7,287,999 B2 10/2007 Holterhoff et al.
2006/0128206 A1 * 6/2006 Oesterhaus ..... 439/441

* cited by examiner

*Primary Examiner*—Ross N Gushi
(74) *Attorney, Agent, or Firm*—GE Global Patent Operation

(57) ABSTRACT

An electrical terminal block assembly including a housing having one or more terminals, each of the terminals including a terminal assembly having a resilient member and a contact surface configured to releasably secure a conductor within the terminal and an operating lever removably hinged to the housing, the operating lever being configured to interface with the resilient member for increasing a distance between the resilient member and contact surface to allow passage of a conductor between the resilient member and contact surface.

6 Claims, 15 Drawing Sheets

CONTACT TERMINAL FOR CONDUCTORS

BACKGROUND

1. Field

The subject matter described herein relates generally to contact terminals for conductors and, more particularly, to contact terminals having screw-less conductor interfaces.

2. Related Art

Generally contact terminals, such as electrical contact terminals, have a retention mechanism for holding conductors, such as electrical wires, within the terminal. One type of terminal includes box or cage clamps for securing the conductors to the terminal. For example, the box or cage clamps generally may include a box structure having an open top and bottom through which the conductor is inserted. A movable wall of the box structure is closed on the conductor by, for example, turning a screw for compressing the conductor between the movable wall and a stationary wall of the box. The compressive force of the box clamp holds the conductor within the terminal. Other types of terminals include springs for securing the conductor within the terminals. However, generally the springs are not easily releasable without using a tool. For example, a small screwdriver to nail may be inserted into a hole in the terminal to release the spring. Some of the spring retention terminals include release devices for the springs but these release devices are generally not removable or replaceable in the event the release device is damaged.

There is a need for a contact terminal that allows for easy insertion of the conductor and exhibits a reliable connection between the terminal and the conductor.

BRIEF DESCRIPTION OF THE EMBODIMENTS

In accordance with one exemplary embodiment, an electrical terminal block assembly is provided. The electrical terminal block assembly includes a housing having one or more terminals, each of the terminals including a terminal assembly having a resilient member and a contact surface configured to releasably secure a conductor within the terminal and an operating lever removably hinged to the housing, the operating lever being configured to interface with the resilient member for increasing a distance between the resilient member and contact surface to allow passage of a conductor between the resilient member and contact surface.

In accordance with another exemplary embodiment, a terminal assembly for an electrical terminal block assembly is provided. The terminal assembly includes a terminal support, an electrical contact member mounted to the terminal support and a spring assembly mounted to the contact member, the spring assembly including a spring support having a wall with a first and second end, a spring mounting surface extending from the first end and a contact engagement surface extending from the second end to form a channel, and a spring mounted to the spring mounting surface and extending within the channel from the spring mounting surface towards the contact engagement surface where deflection of the spring is in a plane substantially parallel to the wall, the contact engagement surface and contact having interlocking members for securing the electrical contact member and spring assembly together without tools.

In accordance with yet another exemplary embodiment, a modular electrical terminal block assembly is provided. The modular electrical terminal block assembly includes a housing having one or more terminals, each of the terminals including a terminal assembly configured to releasably secure a conductor within the terminal, an operating lever removably hinged to the housing, the operating lever being configured to interface with the terminal assembly for effecting at least a substantially resistance free insertion of the conductor into the terminal assembly and at least one terminal coupling configured to couple one or more accessory and or auxiliary terminal blocks to the housing.

In accordance with still another exemplary embodiment a resilient member for a terminal assembly is provided. The resilient member including a mounting leg configured for mounting to a resilient member mounting surface of the terminal assembly, an extension leg extending at an angle away from and relative to the mounting leg towards a contact engagement surface of the terminal assembly and in a direction opposite an insertion direction of a conductor and a hooked portion having an engaging portion extending towards the contact engagement surface at an angle relative to the insertion direction and at an angle relative to the extension leg, the engaging portion being configured to substantially prevent the conductor from moving in a direction opposite the insertion direction, where the mounting leg, extension leg, bent portion and engaging portion are connected to each other in series.

BRIEF DESCRIPTION OF THE DRAWINGS

The following detailed description is made with reference to the accompanying drawings, in which.

DETAILED DESCRIPTION OF THE PREFERRED EMBODIMENTS

Figure 1:
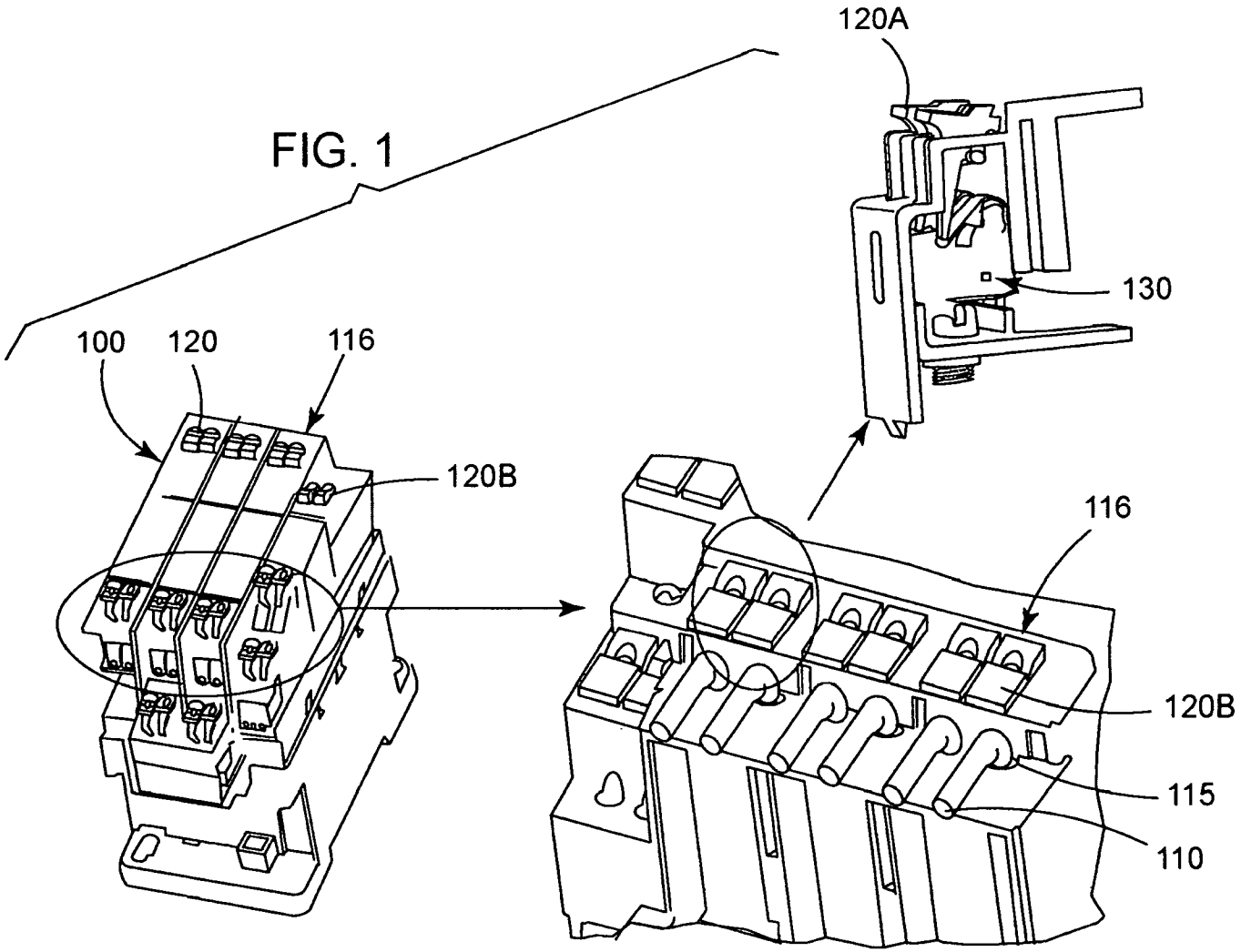
FIG. 1 is a schematic illustration of a terminal block assembly in accordance with an exemplary embodiment.

In one embodiment, a terminal block assembly 100 is provided. Although the embodiments disclosed will be described with reference to the drawings, it should be understood that the embodiments disclosed can be embodied in many alternate forms. In addition, any suitable size, shape or type of elements or materials could be used.

The disclosed embodiments provide for a terminal block assembly 100 including terminal assemblies 130 that allow for a reliable connection between a conductor 110 and a respective terminal 116. The terminals 116 are configured so that the conductor 110 can be inserted and securely held within the respective terminal 116 without the use of tools for securing the conductor. The terminals 116 also provide for releasing the conductor 110 for removal from the terminal block assembly 100 without the use of tools. The terminal block assembly 100 and its terminal assemblies 120 are easily maintainable and customizable to suit a variety of applications.

Figure 2:
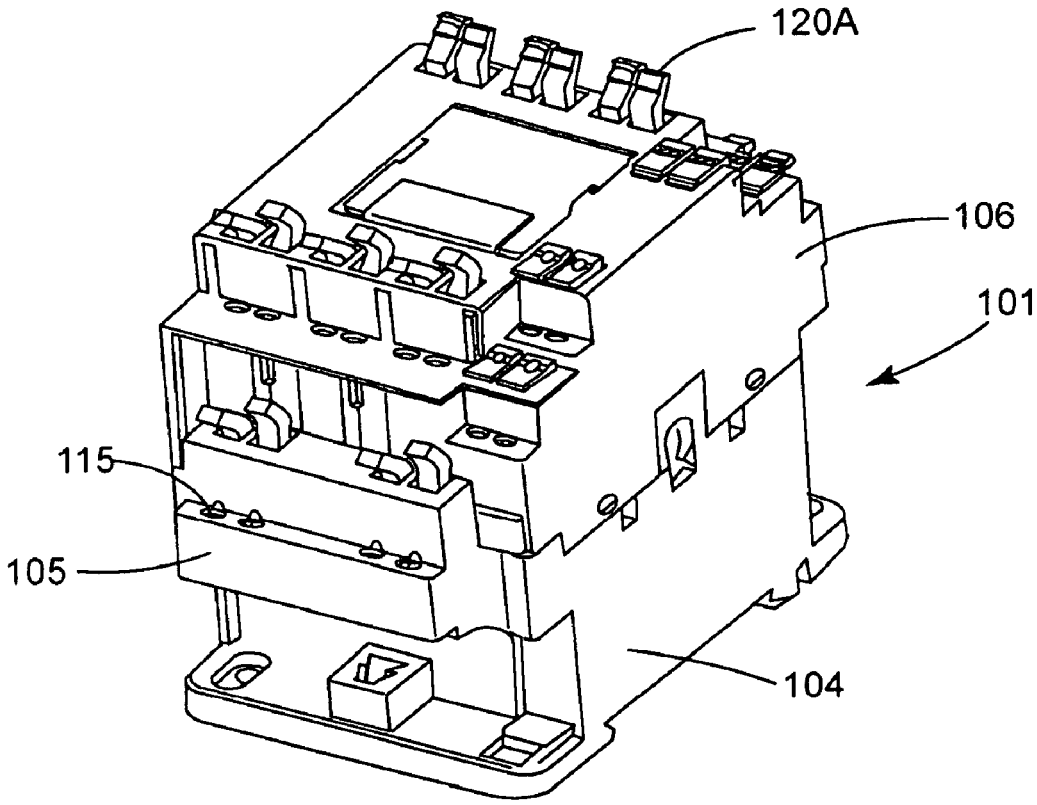
FIG. 2 is a schematic illustration of another terminal block assembly in accordance with an exemplary embodiment.
Figure 3:
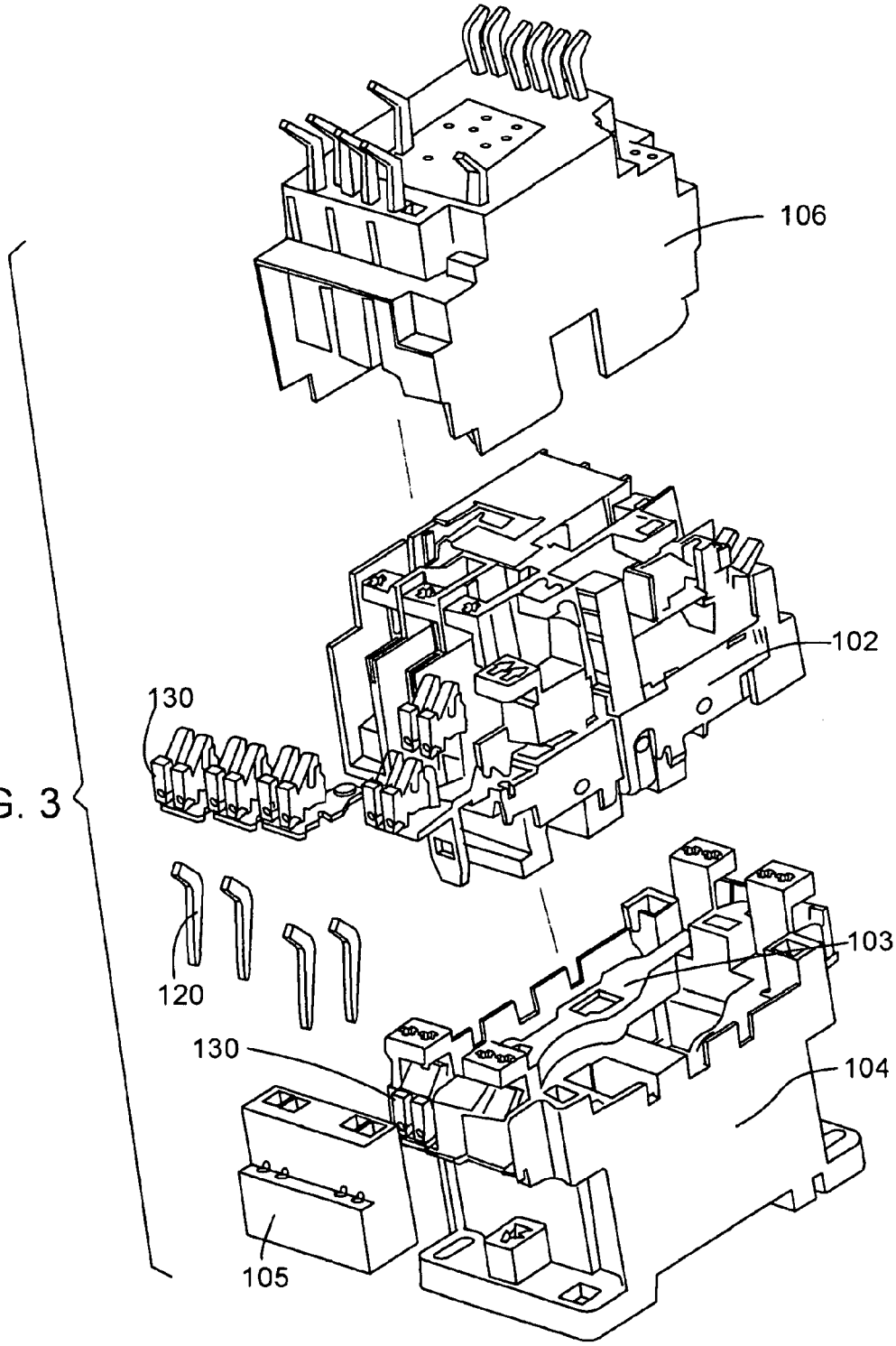
FIG. 3 is an exploded view of an exemplary terminal block assembly in accordance with an exemplary embodiment.

Referring to FIGS. 1-3, in one exemplary embodiment the terminal block assembly 100 may include a base 104, a bobbin 103, one or more terminal covers 105, a housing 102, and a housing cover 106. The bobbin 103 may be configured for mounting to the base 104. In alternate embodiments the bobbin 103 may be of unitary construction or integral to the base 104. The housing 102 may be configured to engage the base 104 in any suitable manner such as, for example, chemical or mechanical fasteners (e.g. snaps, pins, screws, etc.). The terminal cover 105 may cover and/or form part of one or more terminals 116 of the terminal block assembly 100 and be configured to engage one or more of the base 104 and housing 102 in any suitable manner, such as that described above with respect to the housing 102. The housing cover 106 may be configured to cover at least a portion of the housing 102, base 104 and/or terminal cover 105. It should be understood that the terminal block assembly 100 may have any suitable number and types of components that are not limited in any way by those described herein and shown in the Figures.

In this exemplary embodiment, each terminal 116 includes, for example, a terminal opening 115, an operating lever (generally referred to as operating lever 120) and a terminal assembly 130. The terminal opening 115 may be formed in any suitable portion(s) of the terminal block assembly 100 such as, for exemplary purposes only, the terminal cover 105 or housing cover 106. The operating lever 120 may be releasably mounted to any suitable portion of the terminal block assembly 100 such as, for exemplary purposes only, the terminal cover 105 or housing cover 106 as will be described in greater detail below. As can be seen in FIG. 1, the conductor 110 is inserted or otherwise pushed through the terminal opening 115 and is secured in the terminal assembly 130 as will be described in greater detail below. The operating lever 120 may effect releasing of the securing mechanism within the terminal assembly 130 for a reduced force or substantially resistance free insertion of the conductor 110 into the terminal. The operating lever 120 may also effect releasing of the securing mechanism for a reduced force or substantially resistance free removal of the conductor 110 from the terminal. The reduced force or substantially free insertion or removal of the conductor may be less than a force required or resistance encountered when inserting or removing the conductor 110 from the terminal 116 without releasing the securing mechanism. It should be understood that the conductor 110 may also be inserted into the terminal assembly 130 without releasing the securing mechanism with the operating lever 120. It is noted that the conductor 110 may be any suitable conductor such as, for example, a wire or cable having any suitable composition or shape. As can be seen in FIGS. 1 and 2, the operating lever 120 may have any suitable shape and/or configuration such as those shown with respect to operating levers 120A and 120B for effecting the release of the securing mechanism.

Figure 4A:
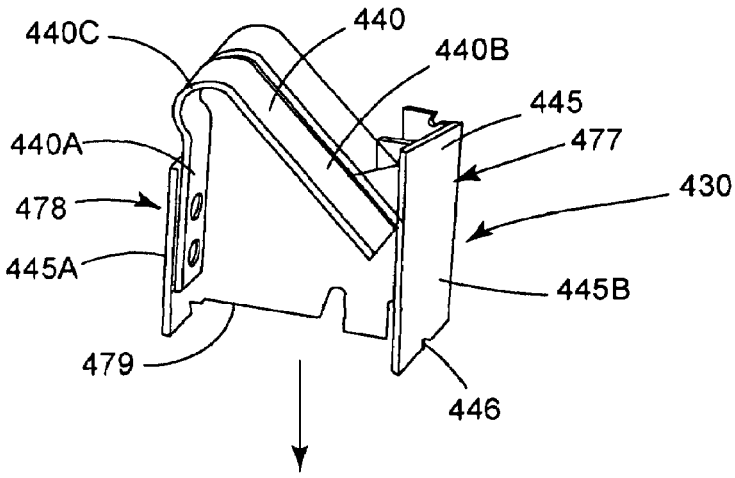
FIGS. 4A-4D illustrate schematic views of a terminal assembly in accordance with an exemplary embodiment.
Figure 4B:
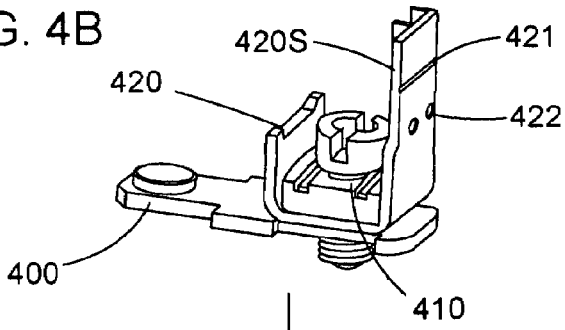
Figure 4C:
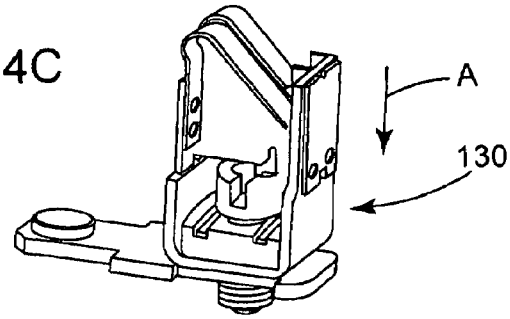

Referring now to FIGS. 4A-4D, in accordance with one exemplary embodiment the terminal assembly 130 may include a terminal support 400, a screw plate assembly 410, a contact 420 and a spring assembly 430. The spring assembly 430 may include one or more resilient members or springs 440 mounted to a spring support 445. The spring support 445 may, for exemplary purposes only, include a wall 479 having a first end 478 and a second end 477. A spring mounting surface 445A may extend from the wall 479 at the first end 478 and a contact engagement surface 445B may extend from the wall at the second end 477 to form a channel through which the spring extends. In this example the spring mounting surface 445A and the contact engagement surface 445B are substantially orthogonal to the wall 479. In alternate embodiments the spring support 445 may have any suitable configuration for mounting a resilient member and interfacing with the terminal support 400 and/or contact 420. As can be seen in FIGS. 4A-4C the contact 420 is secured or otherwise mounted to the terminal support 400 by the screw plate assembly 410. In one exemplary embodiment the terminal support 400 may include a threaded hole for accepting a screw of the screw plate assembly 410. In alternate embodiments the contact 420 may be secured to the terminal support 400 in any suitable manner. The spring assembly 430 may be mounted to the contact 420 in any suitable manner such as by, for example, interlocking apertures 446 and protrusions 422 and/or interlocking grooves 421 (it is noted that while the grooves are shown on the contact, the spring support may have mating protrusions located thereon or vice versa). In this example, the apertures 446 are shown on the spring support 445 and the protrusions are shown on the contact 420 but in alternate embodiments the apertures and protrusions may be located on one or more of the spring support and contact in any suitable manner.

Figure 4D:
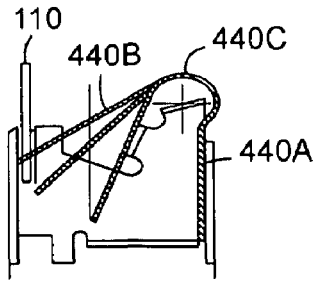
Figure 5A:
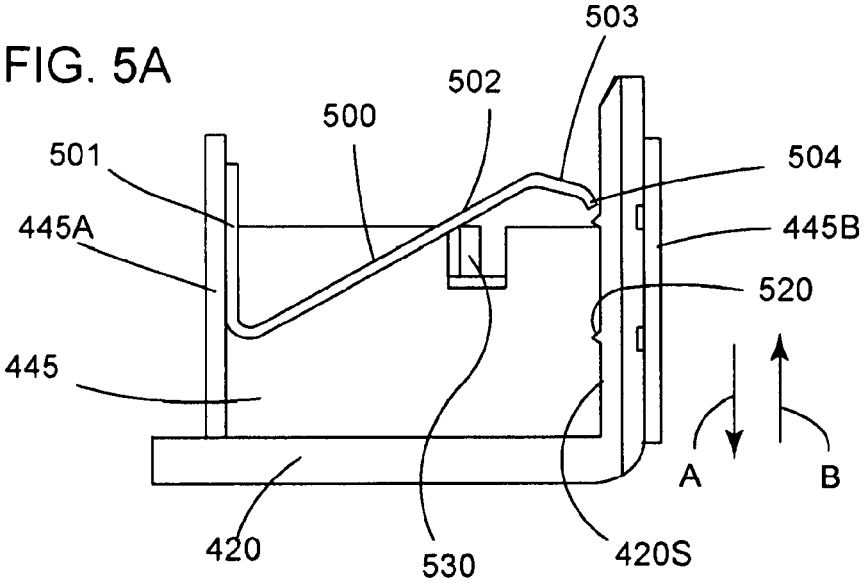
FIGS. 5A-5E illustrate schematic views of a portion of another terminal assembly in accordance with an exemplary embodiment.
Figure 5B:
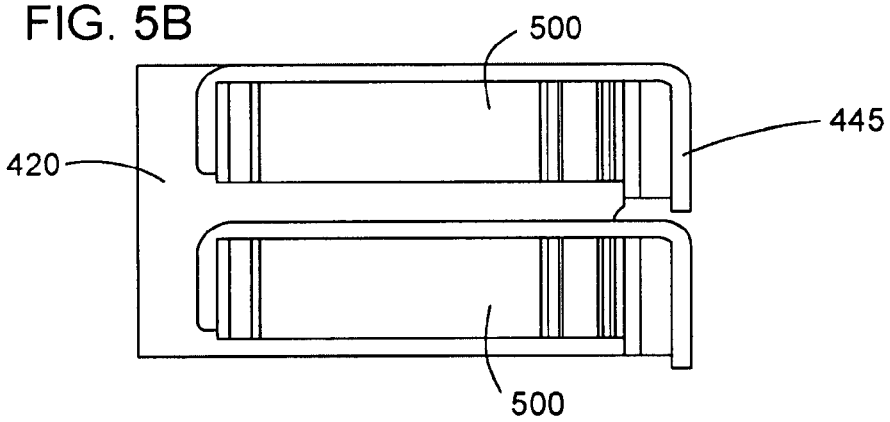
Figure 5C:
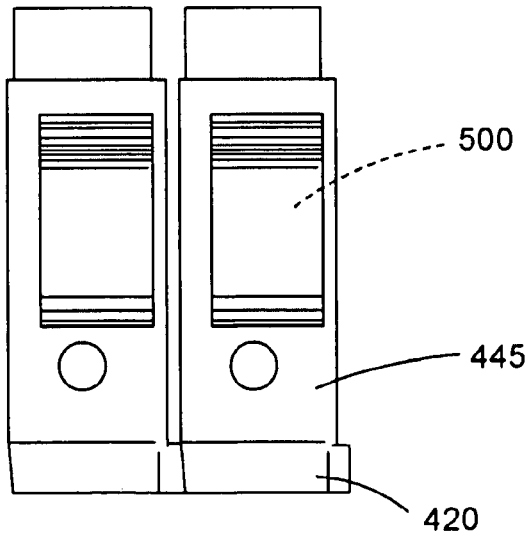
Figure 5D:
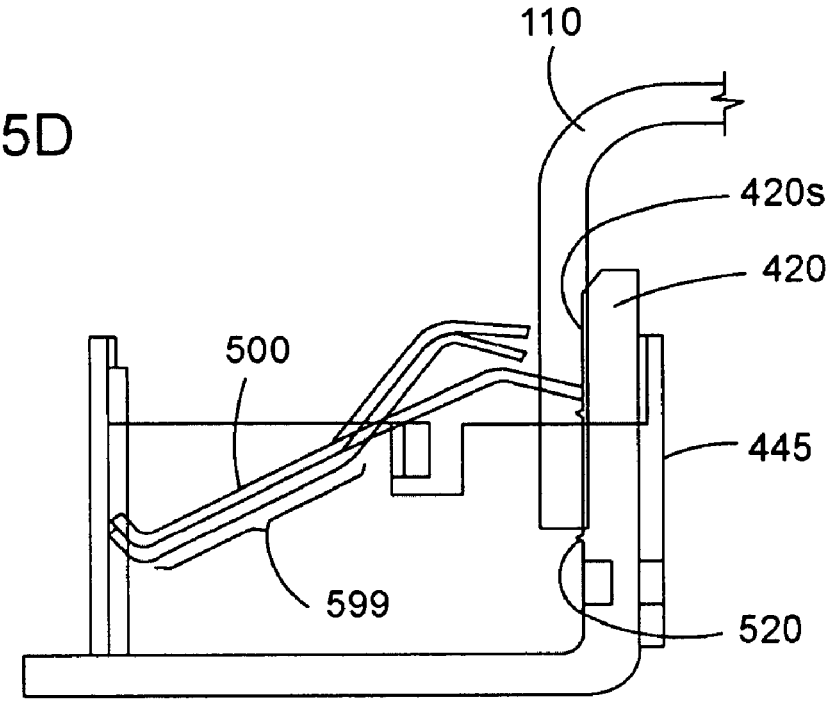
Figure 5E:
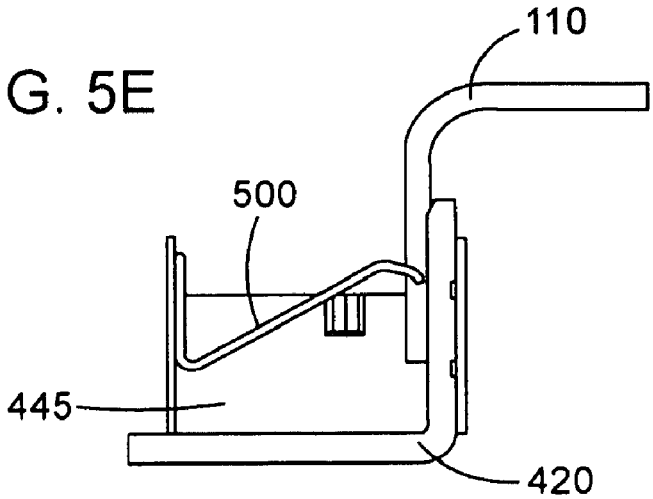

Still referring to FIG. 4A the spring 440 may have any suitable shape configured to provide a suitable holding force against a conductor 110 inserted into the terminal assembly 130 for substantially preventing loosening of the conductor within the terminal assembly 130. In one exemplary embodiment the spring 440 shown in FIG. 4A has a substantially V-shaped configuration where a first leg 440A of the spring 440 is secured to the spring mounting surface 445A of the spring support 445 and a second leg 440B of the spring is resiliently held substantially against or in close proximity to a contact surface 420S of the contact 420 adjacent the contact engagement surface 445B of the spring support 445. The first and second legs 440A, 440B of the spring 440 are connected by a curved portion 440C located substantially at the vertex of the substantially V-shaped configuration. As can be seen in FIG. 4A the second leg 440B of the spring 440 is configured to be at an angle relative to the contact surface 420S so that the conductor may pass between the spring 440 and the contact surface 420S only in one direction A (e.g. the insertion direction) for securely holding the conductor 110 within the terminal assembly 130 so as to form a securing mechanism. The contact surface 420S may also include one or more features for securing the conductor 110 within terminal assembly 130. For example, as shown in FIGS. 5A and 5D, protrusions 520 are shown on the contact surface 420S for securing the conductor 110. In alternate embodiments the contact surface 420S may be configured to secure the conductor in any suitable manner such as through, for example, serrations, knurling or any other surface texturing. As can be seen in FIG. 4D, the stiffness of the spring 440 may be such that bending of the spring 440 occurs substantially at the curved portion 440C, however, in alternate embodiments any portion of the spring may bend in any suitable manner. Over flexing of the spring 440 may be prevented by providing one or more suitable stops 820 (see e.g. FIG. 8A) in the path of travel or deflection of the spring. As can be seen in FIG. 4D, the deflection of the spring is in a plane that is substantially parallel with the wall 479. In alternate embodiments the deflection of the spring may be in any suitable direction relative to the wall 479.

FIGS. 5A-5E illustrate another exemplary spring configuration in accordance with an exemplary embodiment. The spring 500 in this example includes a mounting leg 501, an extension leg 502, a bent portion 503 and an engaging portion 504 connected to each other in series to form a shape substantially in the form of an asymmetrical S. The mounting leg 501 may be configured for mounting the spring 500 to the spring mounting surface 445A. The extension leg 502 extends at an angle away from and relative to the mounting leg 501 towards the contact engagement surface 445B of the spring support 445 and in a direction opposite the insertion direction A. The bent portion 503 and engaging portion 504 form a hooked portion such that a bent portion 503 extends towards contact engagement surface 445B at an angle relative to the extension leg 502 and substantially at an angle towards the direction A while engaging portion 504 continues to extend angularly toward contact engagement surface 445B also at an angle relative to the insertion direction A. In alternate embodiments the spring 500 may have any suitable number of portions having any suitable spatial/angular relationship with each other and/or the contact for securing the conductor within the terminal assembly. The bent portion 503 and engaging portion 504 are configured to allow the conductor 110 to pass between spring 500 and the contact surface 420S while being arranged at a suitable angle relative to the insertion direction A for substantially preventing movement of the conductor 110 in a direction opposite the insertion direction (e.g. the removal direction B) for securing the conductor 110 within the terminal assembly 130. As can be seen best in FIG. 5D, the stiffness of the spring 500 is such that deflection of the spring 500 occurs substantially in the extension leg 502, however, in alternate embodiments any portion of the spring may bend in any suitable manner. It is noted that in this example, the spring 500 may be moved away from the contact surface 420S by applying a force, such as for example, force F2 (see FIGS. 6A and 6B) at a location 599 along the extension leg 502 so that the extension leg is deflected between the mounting leg 501 and stop 530 as shown in FIG. 5D. The stop may also be configured to control any over deflection of the spring as the conductor 110 is inserted into the terminal assembly 130. In alternate embodiments the deflection of the spring 500 may be controlled in any suitable manner. The stop 530 may be formed in or attached to any suitable portion of the terminal block assembly such as, for exemplary purposes only, the spring support 445.

Figure 6A:
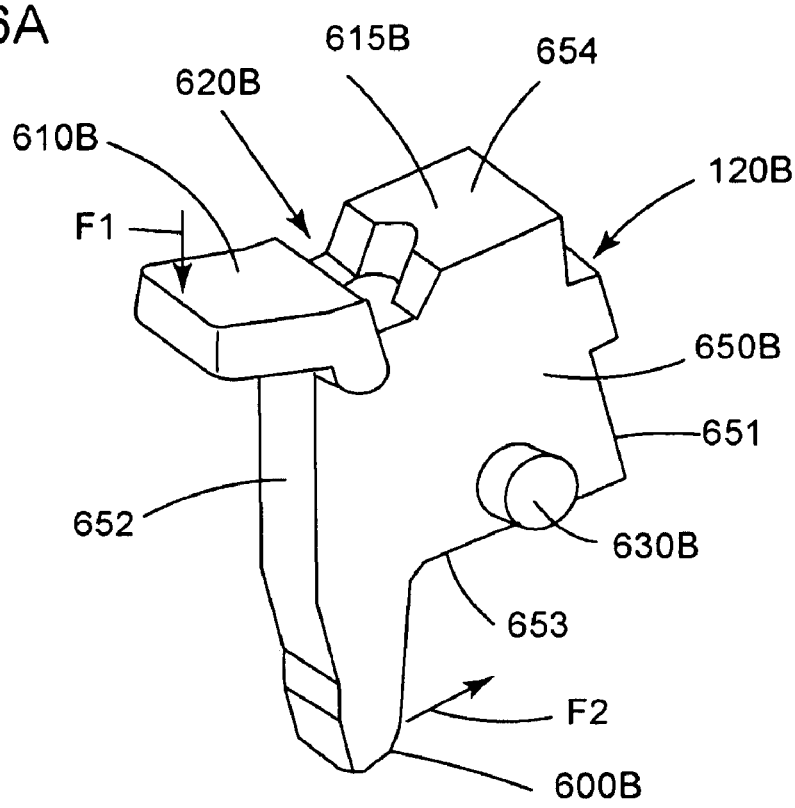
FIGS. 6A and 6B are schematic illustrations of exemplary operating levers for a terminal block assembly in accordance with an exemplary embodiment.
Figure 8A:
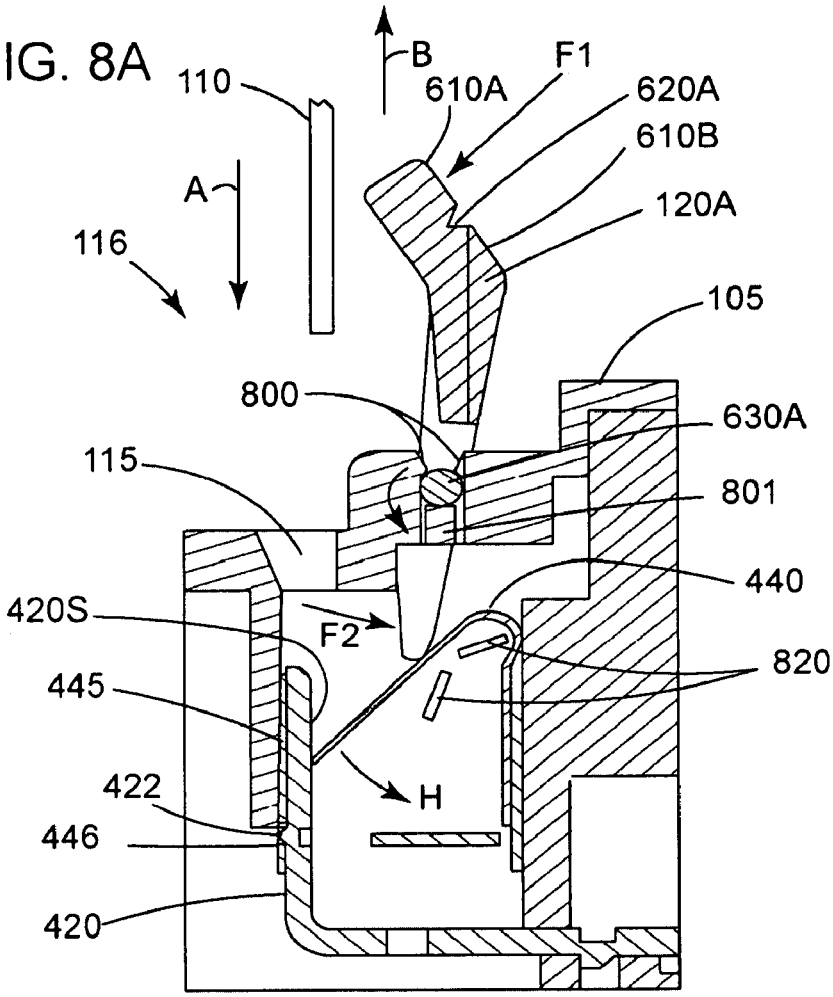
FIGS. 8A and 8B are partial section views of a portion of a terminal block assembly in accordance with an exemplary embodiment.
Figure 8B:
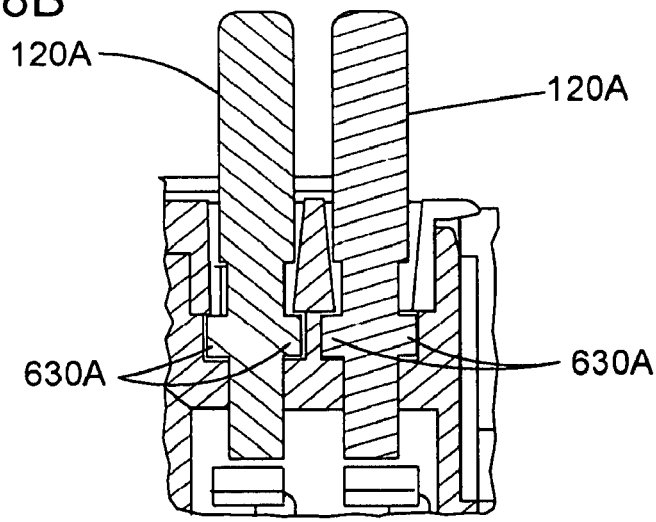

Referring to FIG. 6A an operating lever 120B of the terminal block assembly 100 will be described in greater detail in accordance with an exemplary embodiment. The operating lever 120B may be configured to reduce a force for inserting the conductor in the terminal assembly 130 or to release the conductor 110 from the terminal assembly 130 by increasing a distance between an engaging surface of the spring 440 (e.g. the surface of the spring that interacts with the conductor) and the contact 420. In this example, the operating lever 120B includes a body portion 650B, one or more operating interface surfaces 610B, 615B, a tool interface 620B, a spring interface surface 600B and a fulcrum or pivot member 630B. The body portion 650B may have any suitable shape and/or configuration. In this example the body respectively has a first, second, third and fourth sides 651, 652, 653, 654. The fulcrum 630B protrudes from the body portion and is configured to pivotally couple the operating lever 120B to any suitable portion of the terminal block assembly at a location where the operating lever 120B can interface with a respective spring assembly 430. In this example the location of the fulcrum 630B is biased towards a first side 651 and a third side 653 of the body portion 650B. In alternate embodiments the fulcrum may have any suitable spatial relationship relative to the sides of the body portion. In this example the fulcrum 630B is configured as one or more pin like protrusions (e.g. one protrusion extending from opposite sides of the body portion as can be seen in FIG. 8B). In alternate embodiments the fulcrum may have any suitable configuration. The spring interface surface 600B extends from the third side 653 of the body portion and its location is biased towards a second side 652 of the body portion so that the fulcrum 630B and the spring interface surface 600B are located substantially on opposite ends of the body portion. The lever operating surface(s) 610B, 615B are located on and/or extend from the fourth side 654 of the body portion 650B. In this example, the location of the lever operating surface 610B is biased towards the second side 652 and extends from the fourth side 654 so that it is cantilevered past the second side 652 of the body portion. It is noted that the lever operating surface(s) 610B, 615B may include any suitable surface texture (e.g. knurling, stipples, ridges, grooves, etc.) for aiding in the operation of the lever as described herein. A tool interface 620B is located along the fourth side 654 between the lever operating surfaces 610B, 615B and is configured so that any suitable tool can be inserted into the tool interface 620B for operating the lever 120B. It should be understood that while a tool interface is described, the operating lever 120B may be operated without using the tool interface. In alternate embodiments the operating lever may not include the tool interface. The spatial relationships between the lever operating surface(s) 610B, 615B, the spring interface surface 600B and the fulcrum 630B are such that the force F2 exerted on the spring 440, 500 for deflecting the spring away from the contact surface 420S is greater than a lever operating force F1 applied to the lever operating surface(s) 610B, 615B and/or tool interface 620B. In alternate embodiments the force F2 may be substantially equal to or less than the force F1.

Figure 6B:
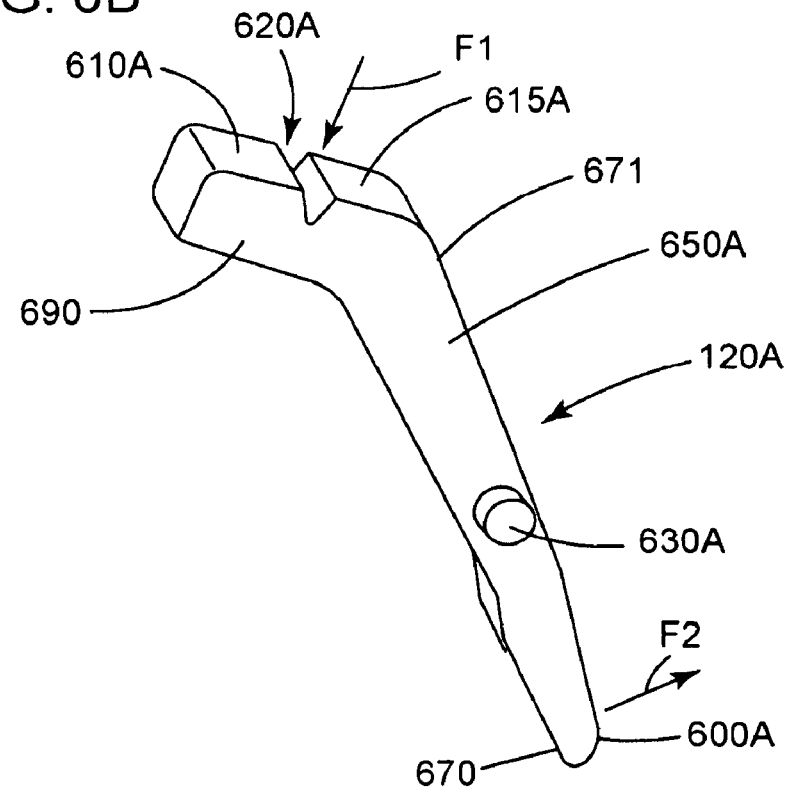

Referring to FIG. 6B another exemplary operating lever 120A will be described in accordance with an exemplary embodiment. In this example, the operating lever 120A has a substantially L-shaped or dog leg configuration. Here the operating lever 120A includes a first leg portion 650A having a first end 670 and a second opposite end 671. A spring interface surface 600A is located at the first end 670 of the first leg portion 650A for interfacing with and effecting the deflection of a corresponding spring within the terminal assembly 130 as described above with respect to FIG. 6A. A fulcrum 630A, which may be substantially similar to fulcrum 630B, extends from the first leg portion 650A at a location that is biased towards the first end 670. In alternate embodiments the fulcrum 630B may be located at any point along the first leg portion 650A. A second leg portion 690 extends away from the second end 671 at an angle relative to a longitudinal axis of the first leg portion 650A. The second leg portion 690 includes one or more lever operating surfaces 610A, 615A and a tool interface 620A that may be substantially similar to those described above with respect to FIG. 6A. As described above, the spatial relationships between the lever operating surface(s) 610A, 615A, the spring interface surface 600A and the fulcrum 630A are such that the force F2 exerted on the spring 440 for deflecting the spring is greater than a lever operating force F1 applied to the lever operating surface(s) 610A, 615A and or tool interface 620A. In alternate embodiments the force F2 may be substantially equal to or less than the force F1. For exemplary purposes only, for a cage size (e.g. the area formed by the contact and spring support) of about 2.5 $mm^2$ the force F1 for inserting the conductor 110 into the terminal assembly 130 may be about 5.9 Newtons (N) to about 6.89 N and the force F1 for removing the conductor 110 from the terminal assembly 130 may be about 8.4 N to about 12.8 N. As another example, for a cage size of about 4 $mm^2$ the force F1 for inserting the conductor 110 into the terminal assembly 130 may be about 7.4 N to about 12.8 N and the force F1 for removing the conductor 110 from the terminal assembly 130 may be about 14 N to about 20.8 N.

Figure 7A:
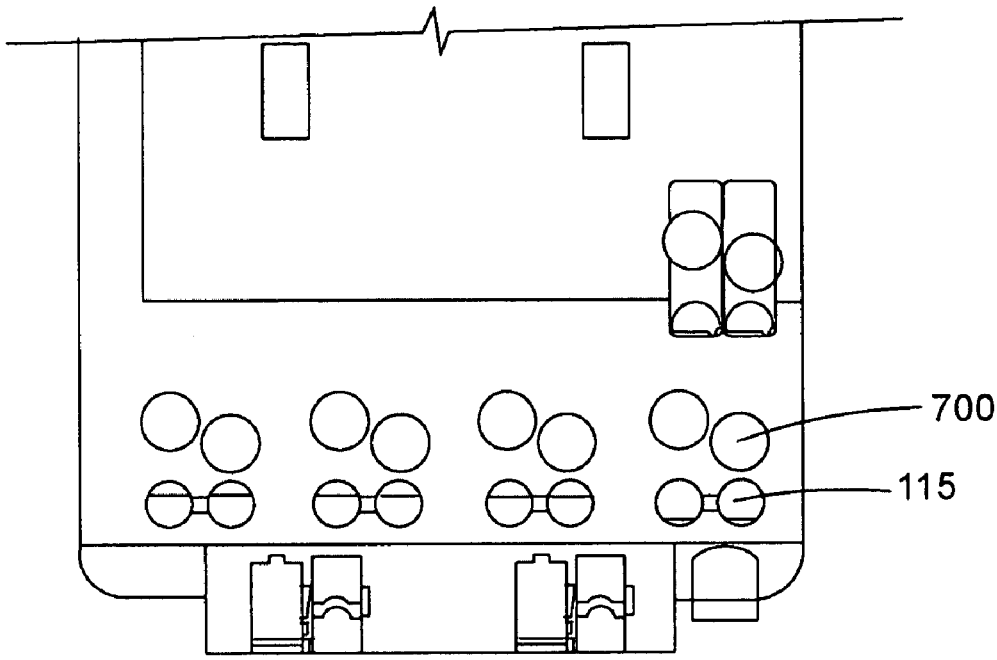
FIGS. 7A and 7B are schematic illustrations of a top and a partial sectional side view of an operating mechanism for a terminal block assembly in accordance with an exemplary embodiment.
Figure 7B:
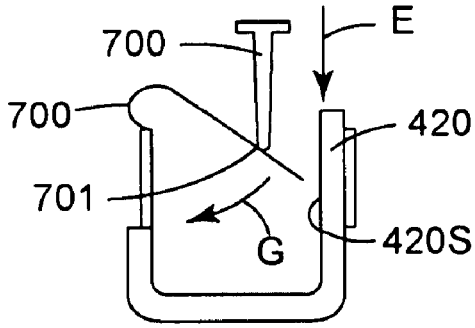

It should be understood that while the mechanism for causing deflection of the spring 440 (or spring 500) within the terminal assembly 130 is described herein an operating lever 120A, 120B, in other embodiments the mechanism may be a push button type mechanism. For example, as can be seen in FIGS. 7A and 7B, the push button 700 may be configured such that as it is pushed in the direction of arrow E a spring interface surface 701 of the button pushes against the spring 400 causing the spring to move away from the contact surface 420S in the direction of arrow G. The push button 700 may be configured such that it is removably mounted to the terminal block assembly 100 in a manner substantially similar to that described below with respect to levers 120A, 120B so that it can be replaced and/or repaired.

Referring back to FIG. 3 an exemplary assembly of the terminal block assembly 100 will be described in accordance with an exemplary embodiment. It should be understood, however, that different assembly methods may be used depending on, for example, the components and configuration of the terminal block assembly without departing from the scope of the exemplary embodiments. In this example, the bobbin 103 is mounted to the base 104. One or more terminal assemblies 130 may be mounted to the bobbin 103 in any suitable manner. The terminal cover 105 may be mounted to, for example, the base 104. One or more operating levers 120 may be removably mounted in respective openings of the terminal cover 105. Referring to FIGS. 8A and 8B the terminal cover 105, for example, may include a fulcrum support 801 and protrusions or snaps 800 that form a channel for accepting the fulcrum 630A. The distance between the snaps 800 is such that the fulcrum 630A can be inserted between the snaps 800 while, once inserted into the channel past the snaps 800, the fulcrum 630A is securely held between the snaps 800 and the support 801. There may be sufficient clearance between the fulcrum 630A and snaps 800/support 801 such that the operating lever 120A is freely pivotable about the fulcrum 630A when mounted to the terminal cover 105. Still referring to FIG. 3, it is noted that operating lever 120B may be mounted to the terminal block assembly in substantially the same manner as that described above with respect to operating lever 120A. One or more terminal assemblies may be mounted to the housing 102 in a manner substantially similar to that described above with respect to the bobbin 103. The housing 102 may be mounted to the base 104 and the housing cover 106 may be mounted to the housing 102. One or more operating levers 120 may be mounted in corresponding openings of the housing cover 106 in a manner substantially similar to that described above with respect to FIGS. 8A and 8B. It is noted that the components of the terminal block assembly 100 described above may be configured so that the terminal block assembly 100 may be assembled with or without tools. For example, the components of the terminal block assembly may be configured so they are snap fit to each other or held together with any suitable mechanical or chemical fasteners.

Referring again to FIG. 8A, an exemplary operation for inserting and removing a conductor 110 to and from a terminal 116 will be described. In one exemplary operation the conductor 110 may be inserted into the terminal 116 my pushing the conductor 110 into the terminal opening 115 in the direction of arrow A. Pushing the conductor 110 through the terminal opening 115 causes the conductor 110 to be forced between the spring 440 and the contact surface 420S so that the conductor 110 causes movement of the spring in the direction of arrow H. As the conductor 110 is pushed between the contact surface 420S and the spring 440 the spring 440 and/or the protrusion(s) 520 on contact surface 420S substantially prevent movement of the conductor in the direction of arrow B for securely holding the conductor 110. In another exemplary operation the insertion force of the conductor 110 may be reduced by operating the operating lever 120A while inserting the conductor 110 into the terminal opening 115. For example, a force F1 is applied to operating interface surface 610A, 610B or tool interface 620A. The application of force F1 causes the operating lever to pivot about fulcrum 630A for exerting a force F2 on the spring 440. The exertion of force F2 on the spring 440 causes the spring 440 to move in the direction of arrow H for separating the spring 440 from the contact surface 420S. Depending on the degree of separation between the spring 440 and contact surface 420S caused by rotation of the operating lever 120A, the conductor 110 can be inserted between the spring 440 and contact surface 420S with reduced resistance or substantially no resistance from the spring 440 and/or contact surface 420S. The conductor 110 can be removed from the terminal 116 by operating the operating lever 120A in the manner described above while moving the conductor in the direction of arrow B.

Figure 9:
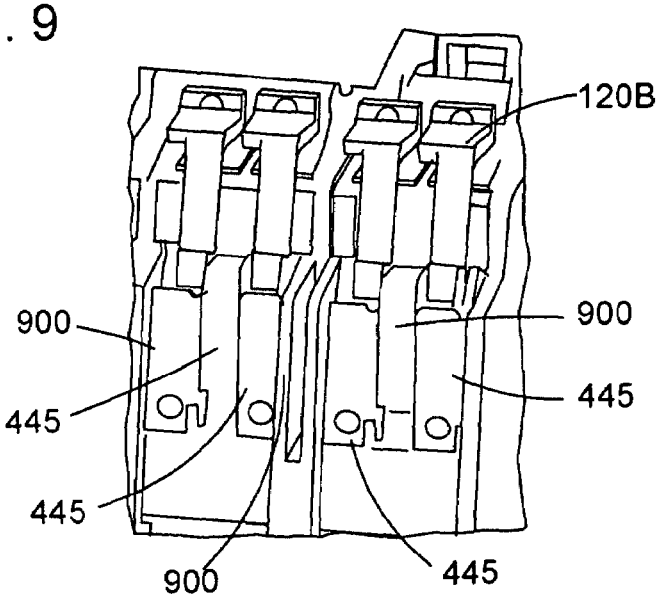
FIG. 9 is a schematic illustration of a portion of a terminal block assembly in accordance with an exemplary embodiment.
Figure 10:
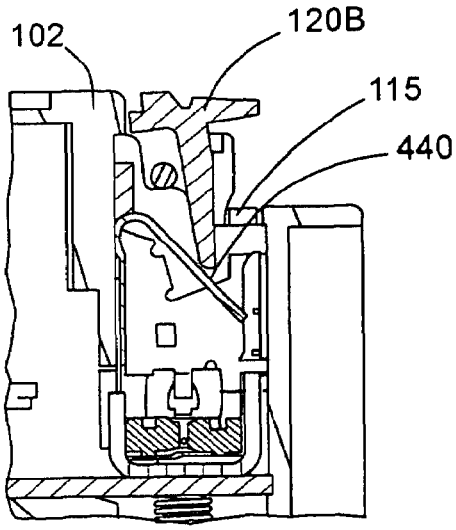
FIGS. 10 and 11 are partial schematic section views of a portion of a terminal block assembly in accordance with an exemplary embodiment.
Figure 11:
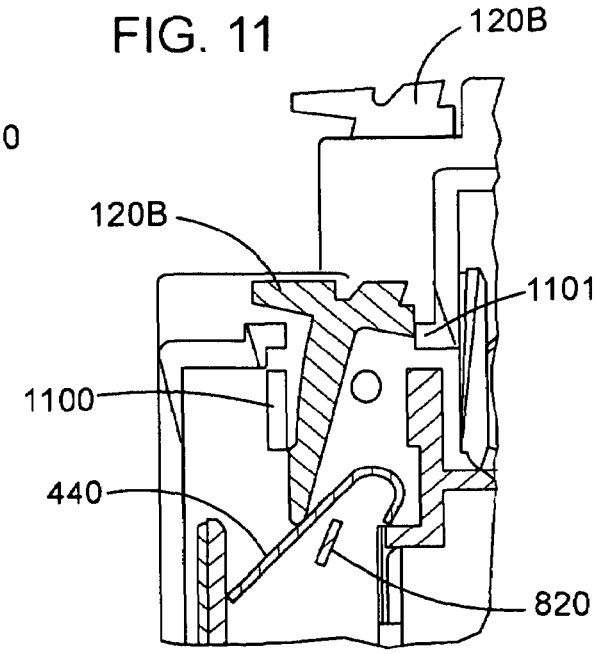

Referring now to FIGS. 9-11, exemplary partial views of an assembled terminal block assembly, such as for example, terminal block assembly 100 (see FIG. 1) are shown. As can be seen in FIG. 9, one or more walls 900 may be placed between springs 440 of terminal assemblies 130 to form chambers in which a respective conductor 110 is secured. The walls 900 may cooperate with one or more of the spring 440 and the contact 420 for guiding the conductor 110 into the terminal assembly 130 so that the conductor 110 is positively latched within the terminal assembly 130 between the spring 440 and contact 420. FIG. 10 illustrates an exemplary operating lever 120B position relative to the spring 440 so that the operating force on the lever 120B for deflecting the spring 440 is minimized. As can be seen in FIG. 11, in addition to the spring over flexing stop 820 the terminal block assembly may include addition stops 1100, 1101 for limiting the travel of the operating lever 120B. The stops 1100, 1101 may be formed on or be integral with any suitable component of the terminal block assembly, such as for example, the cover 106 and terminal cover 105.

Figure 12A:
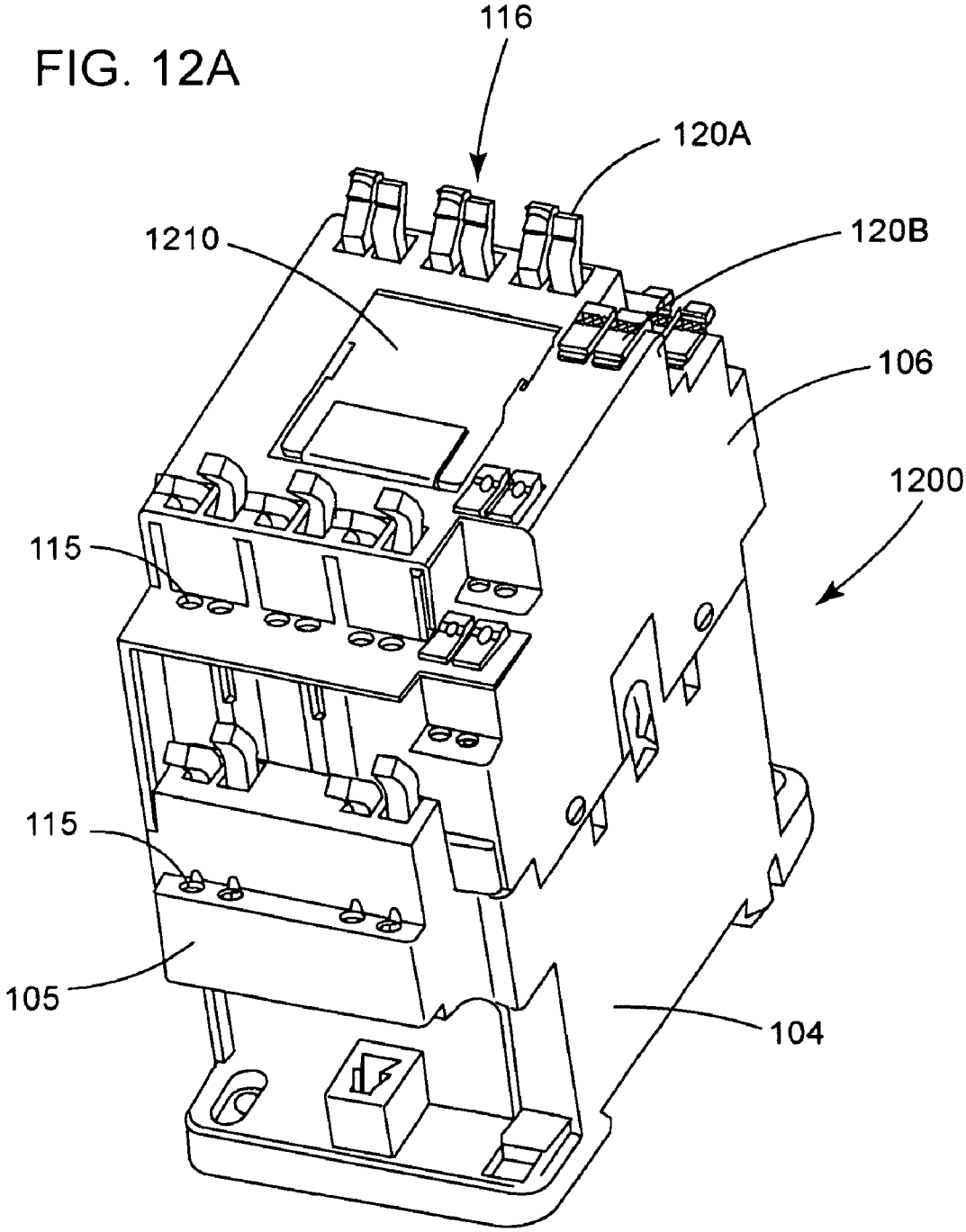
FIG. 12A is a schematic isometric view of a terminal block assembly in accordance with an exemplary embodiment.
Figure 12B:
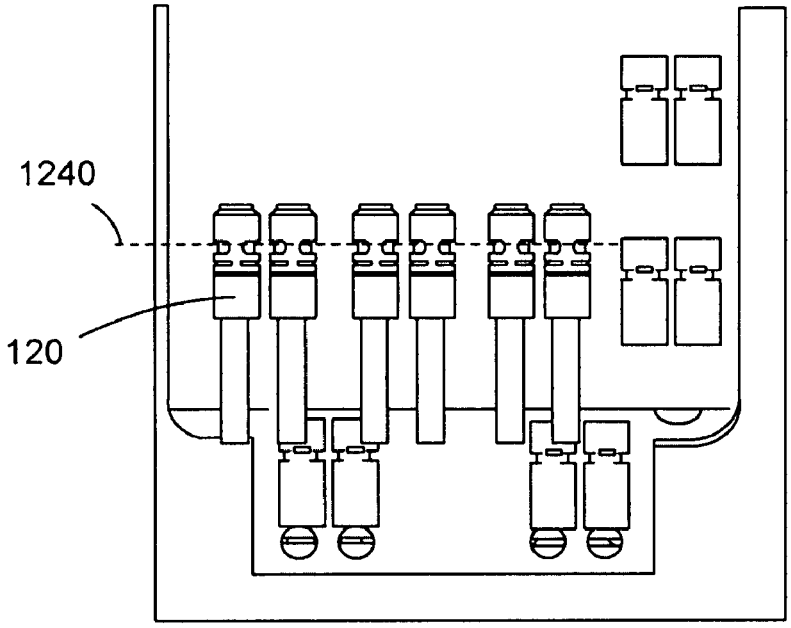
FIGS. 12B and 12C are schematic partial views of the terminal block assembly of FIG. 12.
Figure 12C:
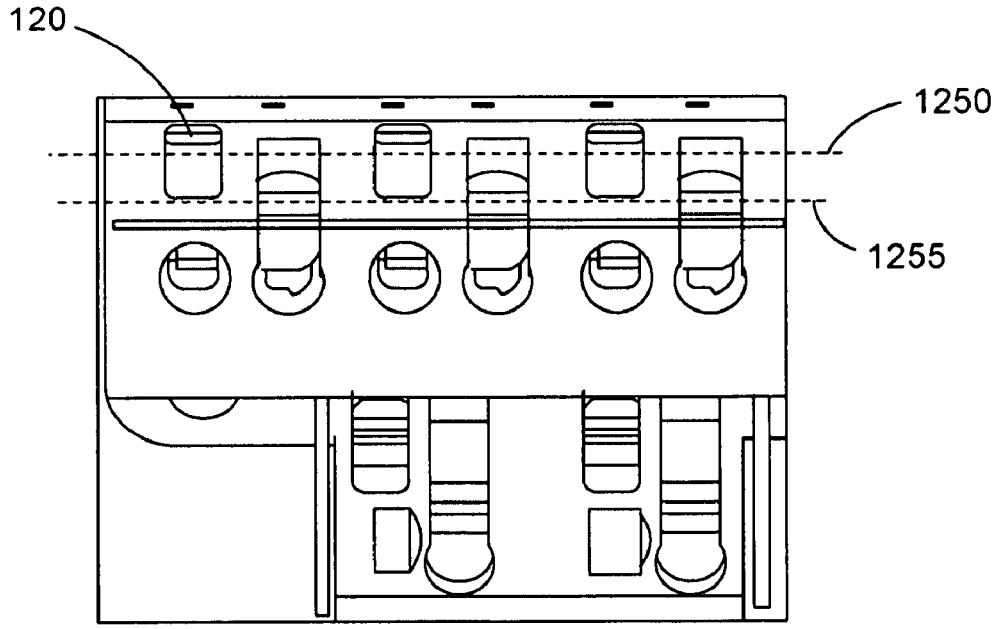

It should also be understood that a terminal block assembly may include one or more different types of operating levers including, but not limited to, those described herein. For example, referring to FIG. 12A, a terminal block assembly 1200 is shown including operating levers 120A and operating levers 120B. As also can be seen in FIG. 12A, the terminal block assembly 1200 may include any suitable connector 1210 for attaching additional terminals to the terminal block assembly as shown in FIGS. 13A-14D described below. It is noted that the terminal block assemblies and the connectors, such as connector 1210 described herein are configured so that each terminal 116 of the terminal block assemblies are connected to an electrical source or sink for transmitting power to or from a respective conductor 110. The operating levers may also be positioned relative to one another to allow for easy operation of the levers. For example, referring to FIGS. 12B and 12C, the operating levers 120 may be located along one line 1240 (e.g. lined up in a row) or staggered between two lines or rows 1250, 1255. Where the operating levers 120 are staggered between to lines 1250, 1255 the operating levers in a line of operating levers are alternately staggered so that adjacent operating levers 120 are located on different lines 1250, 1255.

Figure 13A:
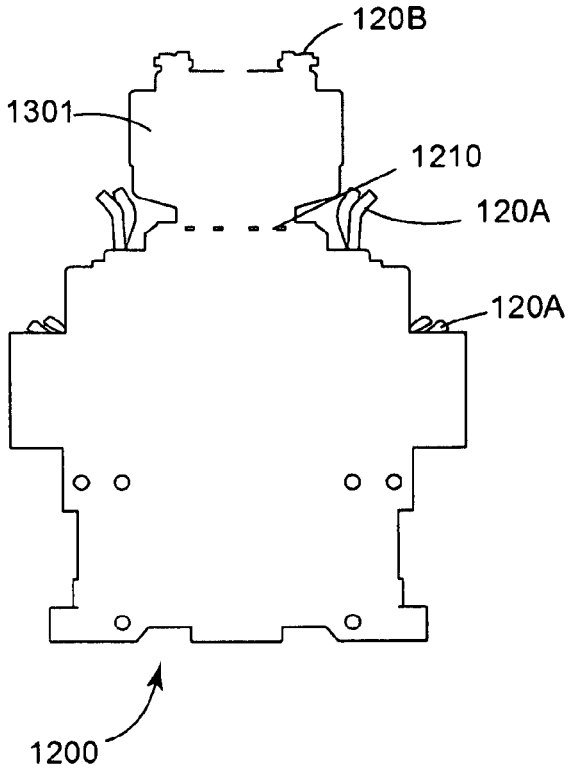
FIGS. 13A-13C are respectively schematic side, front and top views of a terminal block assembly in accordance with an exemplary embodiment.
Figure 13B:
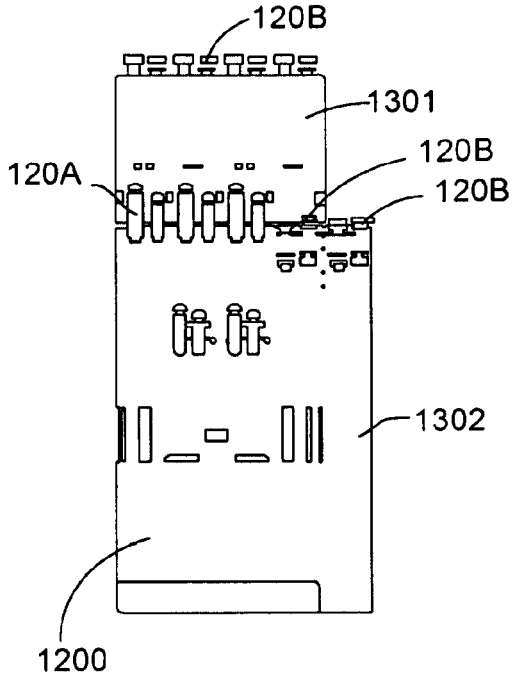
Figure 13C:
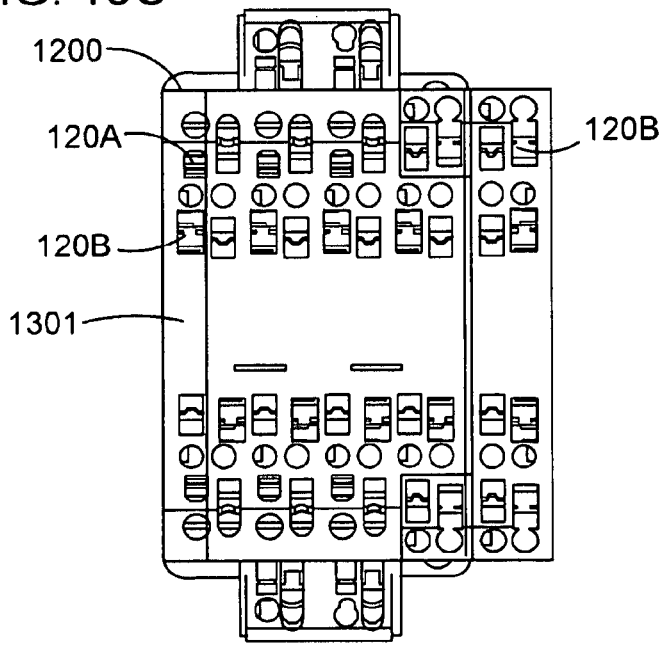
Figure 14A:
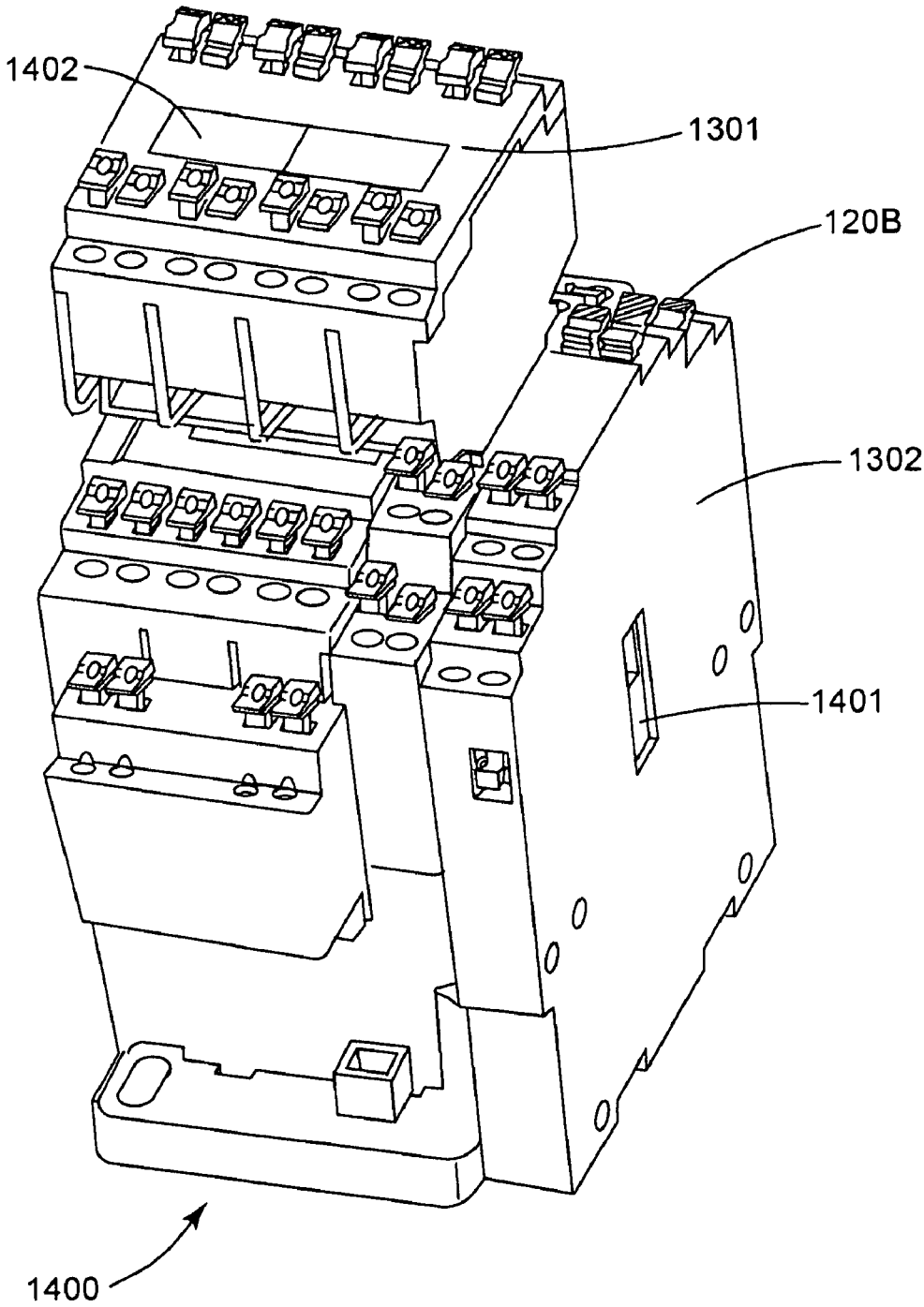
FIGS. 14A-14D are respectively schematic isometric, side, front and top views of another terminal block assembly in accordance with an exemplary embodiment.
Figure 14B:
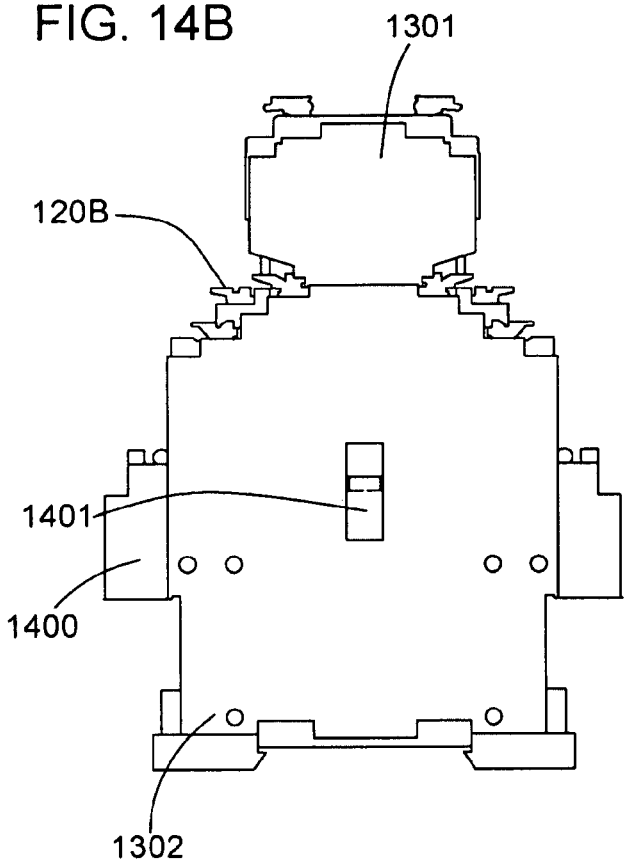
Figure 14C:
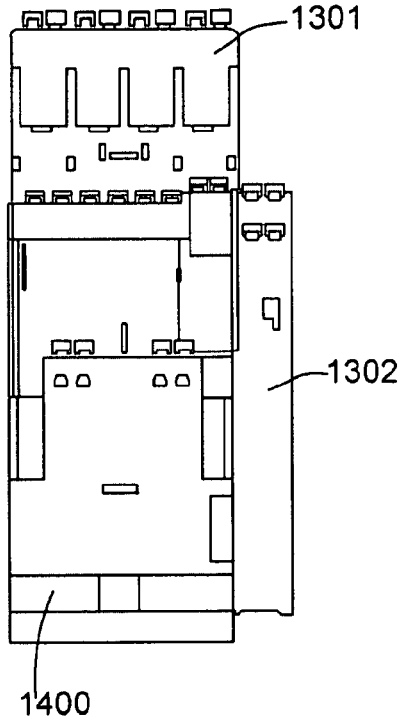
Figure 14D:
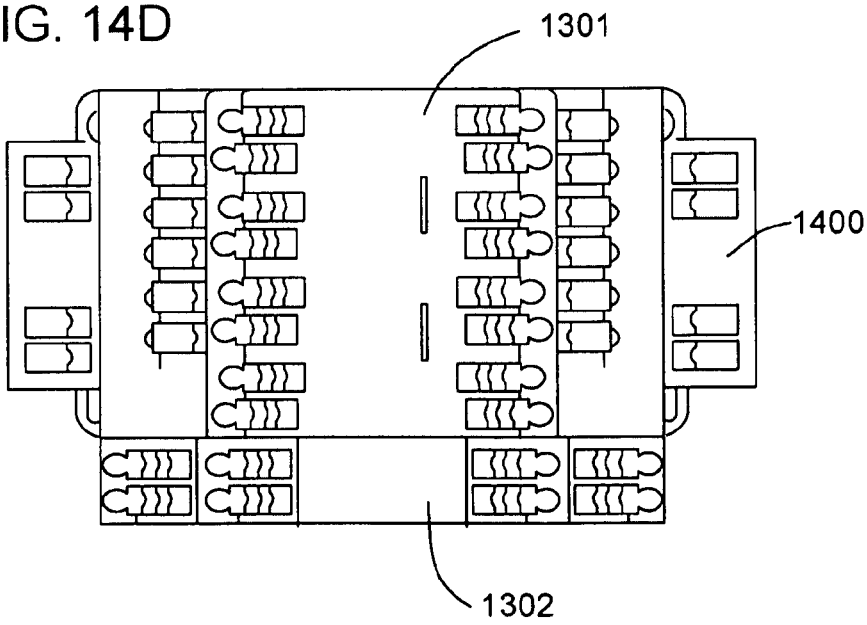

FIGS. 13A-13C respectively illustrate side, front and top views of a terminal block assembly 1200 described above which may include operating levers substantially similar to operating levers 120A and 120B. As described above, the terminal block assembly 1200 may include connector 1210 (see also FIG. 12A) for attaching an additional terminal block assembly or assemblies 1301 to the terminal block assembly 1200. The terminal block assembly 1200 may also include one or more suitable connectors for attaching additional terminal block assemblies 1302 to the sides of the terminal block assembly 1200. The additional terminal block assembly 1301 may have any suitable configuration and may be substantially similar to the terminal block assemblies described above. In this exemplary embodiment the additional terminal block assembly 1301 includes operating levers substantially similar to operating levers 120B. FIGS. 14A-14D respectively illustrate isometric, side, front and top views of a terminal block assembly 1400 substantially similar to terminal block assembly 1200, however all of the operating levers on terminal block assembly 1400 are substantially similar to operating lever 120B. As can be seen in FIGS. 14A-14D additional terminal block assemblies 1301, 1302 are attached to the terminal block assembly 1400. It is noted that the additional terminal block assemblies 1301, 1302 may also include suitable connectors 1401, 1402 for attaching other terminal block assemblies to form a modular terminal block system.

The exemplary embodiments described herein provide for an electrical terminal block assembly in which conductors can be inserted with or without the use of tools. The exemplary embodiments also operate so that a mechanical advantage of an operating lever is used to insert the conductor into the terminal with a reduced force. The mechanical advantage of the operating lever may also be used for removal of the conductor from the terminal. The operating levers are removably attached to the terminal block assembly so that they can be easily replaced and/or repaired. The exemplary embodiments also provide for securely holding the conductor within the terminal block assembly. The terminal block assemblies described herein as also modular in that terminal block assemblies can be joined together or taken apart to form a terminal block assembly having any suitable number of terminals (e.g. main terminals, auxiliary terminals, etc.).

While embodiments have been described in connection with what are presently considered to be the most practical and preferred embodiments, it is to be understood that the embodiments are not limited to those disclosed herein. Rather, the embodiments described are intended to cover all of the various modifications and equivalent arrangements included within the spirit and scope of the appended claims. It should also be understood that the exemplary embodiments may be used individually or in any combination thereof.

What is claimed is:

1. A terminal assembly for an electrical terminal block, the terminal assembly comprising:

a terminal support;

an electrical contact member mounted to the terminal support, a spring assembly mounted to the contact member, the spring assembly including a spring support having a wall with a first and second end, a spring mounting surface extending from the first end and a contact engagement surface extending from the second end to form a channel, and a spring mounted to the spring mounting surface for securing the conductor within a respective terminal, having a substantially asymmetric S-shaped configuration being and configured to extend within the channel from the spring mounting surface towards the contact engagement surface where deflection of the spring is in a plane substantially parallel to the wall, the contact engagement surface and contact having interlocking members for securing the electrical contact member and spring assembly together without tools; and wherein the spring further comprises:

a mounting leg configured for mounting to the spring mounting surface;

an extension leg extending at an angle away from and relative to the mounting leg towards the contact engagement surface and in a direction opposite an insertion direction of a conductor; and a bent portion and an engaging portion both extending towards the contact engagement surface at an angle relative to the insertion direction and at an angle relative to the extension leg, the engaging portion being configured to substantially prevent the conductor from moving in a direction opposite the insertion direction; and where the mounting leg, extension leg, bent portion and engaging portion are connected to each other in series.

2. The terminal assembly of claim 1, wherein the wall comprises a stopping member configured to engage the extension leg and restrict deflection of the spring, the stopping member being positioned relative to the spring so that when a force is exerted on the extension leg the extension leg deflects between the mounting leg and stopping member for effecting increasing a distance between the engaging portion and the contact engagement surface.

3. The terminal assembly of claim 1, wherein the force is exerted on the extension leg by one of a hinged lever or a push button.

4. The terminal assembly of claim 1, wherein the electrical contact includes protrusions configured to cooperate with the spring for engaging and holding a conductor inserted into the terminal assembly.

5. A resilient member for a terminal assembly, comprising: a mounting leg configured for mounting to a resilient member mounting surface of the terminal assembly;

an extension leg extending at an angle away from and relative to the mounting leg towards a contact engagement surface of the terminal assembly and in a direction opposite an insertion direction of a conductor; and a hooked portion having an engaging portion extending towards the contact engagement surface at an angle relative to the insertion direction and at an angle relative to the extension leg, the engaging portion being configured to substantially prevent the conductor from moving in a direction opposite the insertion direction;

where the mounting leg, extension leg, and engaging portion are connected to each other in series; and wherein the extension leg is configured to engage a stopping member of the terminal assembly for restricting deflection of the resilient member, the extension leg being positioned relative to the stopping member so that when a force is exerted on the extension leg between the mounting leg and the stopping member the extension leg deflects between the mounting leg and stopping member for effecting increasing a distance between the engaging portion and the contact engagement surface.

6. The terminal assembly of claim 1, wherein the spring has a substantially V-shaped configuration for securing the conductor within a respective terminal.

* * * * *